US006987360B1

(12) United States Patent
Caplan et al.

(10) Patent No.: US 6,987,360 B1
(45) Date of Patent: Jan. 17, 2006

(54) BACKWARD WAVE COUPLER FOR SUB-MILLIMETER WAVES IN A TRAVELING WAVE TUBE

(75) Inventors: Malcolm Caplan, Fremont, CA (US); Danilo Radovich, Long Beach, CA (US); Carol L. Kory, Westlake, OH (US)

(73) Assignee: "Calabazas Creek Research, Inc", Saratoga, CA (US)

( * ) Notice: Subject to any disclaimer, the term of this patent is extended or adjusted under 35 U.S.C. 154(b) by 4 days.

(21) Appl. No.: 10/814,669

(22) Filed: Mar. 31, 2004

(51) Int. Cl.
*H01J 25/34* (2006.01)

(52) U.S. Cl. ..... 315/3.5; 315/39.3; 315/5.21; 315/5.46; 331/82; 330/4.7

(58) Field of Classification Search ..... 315/3.5, 315/5.19, 5.21, 5.42, 5.51, 5.52, 39.3, 5.46; 331/79, 82; 330/4.6, 4.7; 332/134
See application file for complete search history.

(56) References Cited

U.S. PATENT DOCUMENTS 2,891,191 A * 6/1959 Heffner et al. ..... 315/3.6
2,930,926 A * 3/1960 Hergenrother ..... 315/3.5
3,233,139 A * 2/1966 Chodorow ..... 315/3.5
4,149,107 A 4/1979 Guenard
4,237,402 A * 12/1980 Karp ..... 315/3.5
4,263,566 A 4/1981 Guenard
4,315,194 A * 2/1982 Connolly ..... 315/3.6
4,480,234 A 10/1984 Wachtel
4,807,355 A * 2/1989 Harper ..... 29/600
5,227,701 A * 7/1993 McIntyre ..... 315/5.41
6,313,710 B1 11/2001 Chen et al.
6,417,622 B2 * 7/2002 Theiss ..... 315/3.5

* cited by examiner

*Primary Examiner*—Haissa Philogene
(74) *Attorney, Agent, or Firm*—Jay A. Chesavage

(57) ABSTRACT

A slow wave structure for coupling RF energy with an electron beam comprises a co-propagating RF section including a plurality of pins having a uniform separation from the plane of an electron beam axis. An output aperture is positioned a half wavelength from a reflection section comprising a change in depth of the pintles, such that RF energy reflected by the change in pintle depth is added to the RF energy traveling with the electron beam. One or more rows of pintles are removed in the region of the output aperture to enhance coupling to the output aperture. The device may include a beam shaper for shaping the electron beam to surround the pintles, and the beam shaper and pintles may share common channels which are longitudinal to the electron beam axis. The slow wave structure may operate in forward and backward wave modes, and may be used in conjunction with other structures to form amplifiers and oscillators.

47 Claims, 3 Drawing Sheets

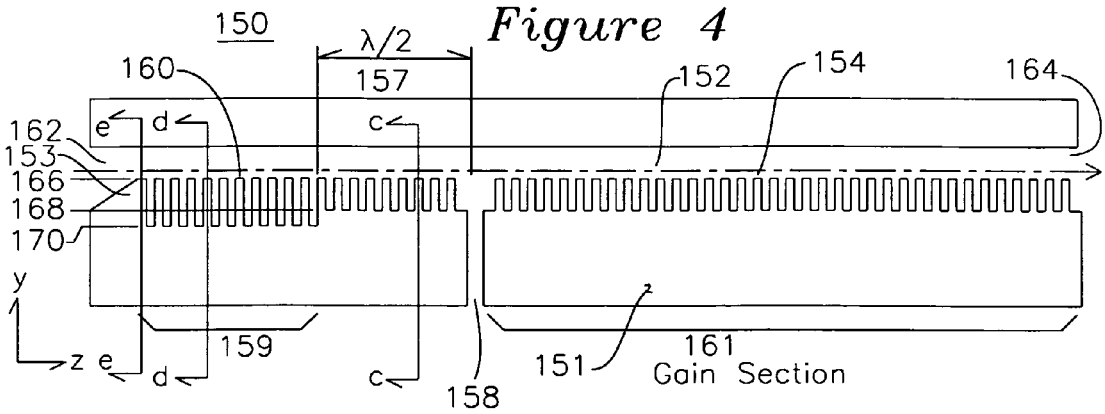
Figure 4
Figure 5a
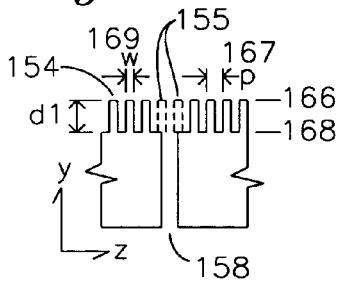
Figure 5b
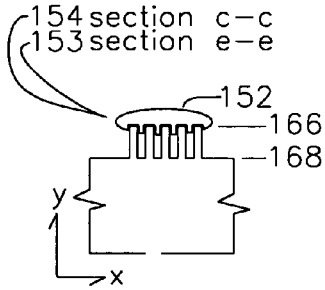
Figure 5c
section d–d
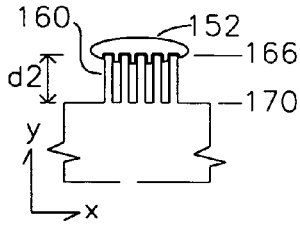
Figure 6
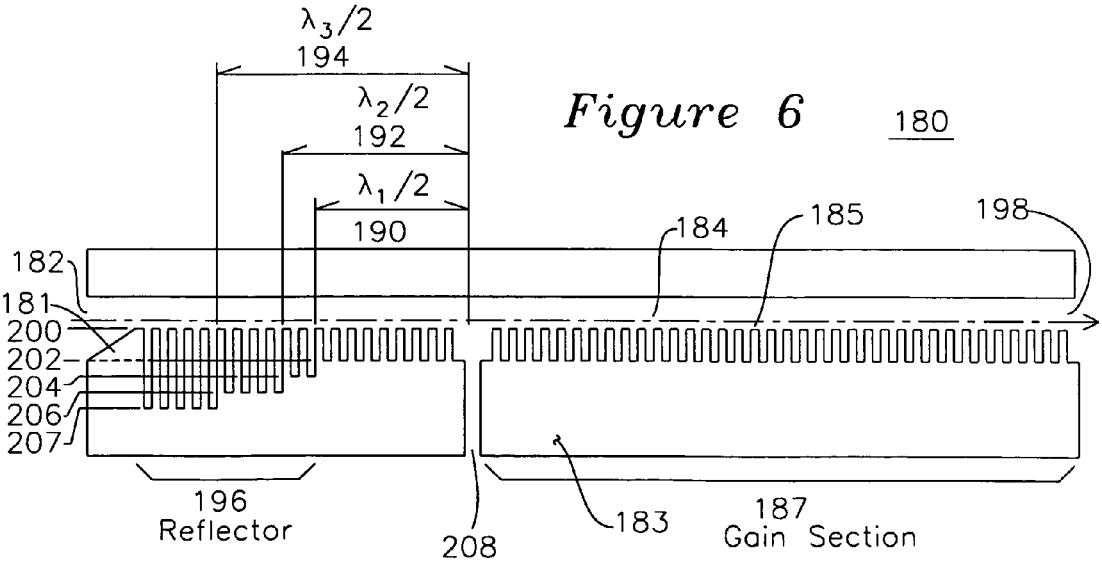

backward wave oscillator forward wave amplifier

BACKWARD WAVE COUPLER FOR SUB-MILLIMETER WAVES IN A TRAVELING WAVE TUBE

This invention was made with United States government support under Grant NAS3-01014 from National Aeronautics and Space Administration. The United States Government has certain rights in this invention.

FIELD OF THE INVENTION

The present invention is related to coupling structures for microwave traveling wave tubes. More particularly, it is related to a structure for coupling traveling waves into and out of a traveling wave tube, including the class of traveling wave tubes operating in the sub-millimeter wavelength region.

BACKGROUND OF THE INVENTION

A Traveling-Wave Tube (TWT) may act as an amplifier or an oscillator for Radio Frequencies (RF). This is accomplished through the interaction of an electron beam and an RF circuit known as a slow wave structure, where the RF wave velocity as it travels down the circuit is much less than that of light in a vacuum. As the electron beam travels down this interaction region, an energy exchange takes place between the electrons and the RF circuit wave. When a traveling wave tube is configured as an amplifier, RF energy is applied to an input port, and the interaction between the RF and the electron beam produces power gain, and the amplified signal is removed from an output port. When a traveling wave tube as an oscillator, at some frequency there is sufficient internal RF coupling through the gain element at a particular frequency to enable oscillation at that frequency. Backward wave devices have the property that this oscillation frequency can be controlled by the voltage applied between the cathode and anode of the electron gun.

FIG. 1 shows the three basic components to any TWT or linear beam device. A TWT includes an electron gun which has a thermionic or field emission cathode 108, a slow wave circuit shown as input coupler 116, output couplers shown as backward wave couplers 118 and 120, and a collector shown as 112. The electron gun emits electrons and the application of a high differential voltage optionally combined with a magnetic focusing circuit (not shown), the electrons travel down electron beam 114 tunnel terminating in collector 112. The voltage applied to the cathode may range in value from several hundred to several hundreds of thousands of volts. The slow wave structure 116 which is shown generically coupled to electron beam 114 may couple RF energy into the electron beam 114, or it may provide a source of oscillation coupled to electron beam 114, or it may act as an amplifier whereby it includes an input port (not shown) and has the characteristic of a bandpass filter for RF waves in the region of interest. Over a particular band of frequencies, which can range as high as two or more octaves, the slow wave structures 118 and 120 may provide a frequency transfer function for the RF energy traveling through them. There are numerous types of slow wave structures including helical, coupled-cavity, and ring-and-bar circuits. The frequency at which the device operates is determined by the geometry and size of the slow wave structures 116, 118, and 120. In a backward wave device, the slow wave structures 118 and 120 cause RF energy in the circuit to counter-propagate, or propagate toward the electron gun to an output port, as will be explained later. After the RF energy has been coupled into and extracted from the electron beam using slow wave structures such as backward wave couplers 118 and 120, the beam enters a region known as the collector 112, which collects the spent beam. There are many collector configurations used in linear beam devices. Some of these include single-stage grounded collectors and multiple stage collectors. The driving concept behind the selection of collector used is efficiency and power supply considerations.

A backward wave device, whether it be an amplifier or an oscillator, is a type of traveling wave device which includes a slow wave structure which causes the phase velocity of a forward moving wave to have a negative value, so that it travels in a direction counter-propagating (opposite the direction of) the electron beam 114.

FIG. 2 shows a ω-β curve for an electron beam interacting with a slow wave structure such as backward wave coupler 120 of FIG. 1, where the x axis 105 is the wave number, which for corrugated structures are normalized to k*d, where:

k is the wave number, or 1/λ, and λ is the wavelength of interest;

d is the depth 123 of the corrugations shown in FIG. 1;

and the period of pitch p 121 of FIG. 1 is constant. The y axis of the graph shows the upper cutoff frequency, for a structure, where $f_{cutoff}$ is proportional to 1/d*c where d=depth of corrugation, as before, c=velocity of light.

Curve 102 is the electron beam line, the slope of which indicates the electron beam velocity as electrons leave the cathode and travel down the beam tunnel, and the slope of this line 102 increases with larger voltage applied by cathode 108 in FIG. 1. The functional characteristics of a slow wave structure having a fixed pitch p 121 from FIG. 1 and varying depth d 123 from FIG. 1 is shown as curve 106*a*, 106*b*, and 106*c*, which for corrugation structures is governed by the parameters p 121 and d 123 both from FIG. 1. Smaller values of d yield a higher cutoff frequency, and larger values of d result in a lower cutoff frequency. Operation of the RF slow wave structure with a large cathode electron acceleration voltage results in an intersection point between the electron beam line 102 and the slow wave structure curve 106*a*, 106*b*, or 106*c* in the region 0 to n, and the device operates as a forward wave device. A reduction of the cathode electron acceleration voltage results in a lower slope of the electron beam line 102, and the electron beam line 102 intersects the RF slow wave structure characteristic curve at point 104. Operating point 104 is shown in the region from n to 2n known as the backward wave region, and the RF waves are counter-propagating with the electron beam, where the RF is propagating in a direction opposite the direction of the electron beam. For a given slow wave structure geometry, as the electron beam voltage is slightly increased, curve 102 has a greater slope, and intersection point 104 supports at a higher operating frequency F1 101. For given operating point 104, traveling waves can be supported up to a frequency F1 101 where the corrugation depth d=80u, as shown in the present example. If the traveling waves experience a change in corrugation depth to 100u as shown in characteristic curve 106*c*, the slow wave structure will no longer support traveling waves at this frequency, and the waves will be reflected in the region of the discontinuous interface where the depth d in increased. The curves 106*a*, 106*b*, and 106*c* are normalized to wave number in the x axis and show the relationship between corrugation depth and the maximum RF frequency the slow structure can support. The curves of FIG. 2 are ordinarily computed using numerical techniques for a specific structure. In the present example, curves of FIG. 2 were calculated for the case where the corrugation pitch p=50u and the width of the individual structures is 20u for a variety of depths d 123 (from FIG. 1) ranging from 40u to 100u. These curves, in conjunction with the electron beam line 102 enable the design of reflecting structures for use in forward or backward wave regions. One of the problems with devices that operate in backward wave regions is the inefficiency of coupling between the slow wave structure and the output waveguide.

FIG. 3 shows a backward wave structure from the unpublished design of a Russian-designed microwave tube available commercially in Russia. An electron beam 135 travels from a beam tunnel entrance 130 through a beam shaper 132 to a beam tunnel exit 138, and beam shaper 132 is at the same height as corrugations 136 having a depth d in accordance with the characteristics of FIGS. 1 and 2. Additionally, the beam shaper includes a series of slots parallel to the electron beam 135 axis which cause the electron beam 135 to travel over and around the corrugations which are perpendicular to the electron beam 135. This dual corrugation produces pin structures known as pintles 136 which have a depth d and pitch p perpendicular to the axis of the electron beam 135. These pintles 136 include longitudinal slots which allow the electron beam to surround the pintles 136, and therefore interact with the them in an enhanced manner. Section z—z through the beam shaper 132 of FIG. 3 is shown as FIG. 3*a* showing the slots in the beam shaper 132 and the electron beam 135 forming around these slots. These slots continue in the pintles 136 shown in section view a—a in FIG. 3*a* with electron beam 135. The cross section through pintles 136 of section b—b is shown in FIG. 3*b*, which effectively shows a top view of the pintles 136 and also pintles 134 from the sloping region of FIG. 3. The pintles 136 are physically small and not well thermally coupled to substrate 131 in FIG. 3, and an imperfectly aligned electron beam 135 directly impinging on these pintles would cause them to overheat and melt. By machining the beam shaper 132 to the same height as the pintles 136, and including slots in beam shaper 132 which continue through pintles 134 and 136, the shaper 132 is able to very closely couple the electron beam 135 with the pintles, tightly coupling the tops and sides of the pintles 136 with the electron beam 135 as shown in FIG. 3*a*. The pintles are therefore shielded from overheating due to direct exposure to a misaligned electron beam by the beam shaper 132, which conducts excess heat into the slow wave structure body 131 from FIG. 3. The operation of the backward wave coupler of FIG. 3 includes the reflection of RF energy carried in the beam by sloping structure 134, whereby reflected wave energy is coupled into the output aperture 140. In the unpublished RF device of FIG. 3, the output port 140 is placed between a row of pintles in the sloped region 134. Fabrication of the device shown in FIG. 3 for use in sub-millimeter wavelengths is very difficult, as the features are on the order of 10s of microns, and the sloping section 134 must be completed prior to the pintle fabrication. The best method for pintle feature manufacturing is electro-discharge machining, which is best done using substantially planar surfaces, as opposed to the sloping surface 134.

In prior art devices such as in U.S. Pat. No. 4,263,566 by Guenard and shown in FIG. 1 structures 118 and 120, the slow wave structures are corrugated in one dimension only such that the cross section of FIG. 1 is correct for any section through the slow wave structure. Similarly, the slow wave structure described in U.S. Pat. No. 4,149,107 by Guenard comprises 1-dimensional slots as shown. In the Russian device of FIG. 3, the corrugations perpendicular to the electron beam are supplemented by slots parallel to the electron beam which produce structures referred to as pintles, which are a plurality of pins spaced on regular intervals, typically 10–20 pintles per wavelength, in accordance with the desired frequency performance as described in FIG. 2. While backward wave devices enable operation over a wide range of frequencies tunable by changing the electron beam voltage, backward wave devices suffer from inefficient coupling of RF energy to the output port and the use of pintles increases the efficiency of this coupling.

OBJECTS OF THE INVENTION

A first object of the invention is a slow wave structure for reflecting RF energy either co-propagating with (traveling in the same direction) an electron beam or counter-propagating with (traveling in the opposite direction) an electron beam.

A second object of the invention is a slow wave structure having a reflector, said reflector causing RF energy counter-propagating in an electron beam to co-propagate to an output port which is spaced a half wavelength from the reflector.

A third object of the invention is a slow wave structure comprising a plurality of pins placed in a substrate, the depth of said pins changing a half wavelength from an output port.

A fourth object of the invention is a slow wave structure comprising a plurality of pins forming a substantially planar surface, said plurality of pins located on a substrate, the depth of said pins undergoing a step change a half wavelength from an output port.

A fifth object of the invention is a slow wave structure comprising a plurality of pins forming a substantially planar surface, said pins located on a substrate, the depth of said pins undergoing a plurality of step changes, each said step change being a distance of half a wavelength from an output port.

A fifth object of the invention is a slow wave structure for an electron beam having an axis, said slow wave structure having, in sequence, a electron beam entrance, an optional beam shaper, a reflection region, a half wave region, an RF output port, a gain region, and an electron beam exit, the slow wave structure having a substrate which includes a plurality of corrugations perpendicular to said axis, said corrugations having a first depth in a region from said beam exit to a half wavelength past the RF output port, and a second depth thereafter, the pins having a substrate end and an unsupported end which is substantially parallel to said electron beam.

A sixth object of the invention is a slow wave structure for an electron beam having an axis, said slow wave structure having a substrate, said substrate having corrugations, said corrugations having one end forming a substantially planar surface, said slow wave structure including, in sequence, an electron beam entrance, a beam shaper having a surface substantially planar with said corrugations, a reflection region having said corrugations at a first depth, a half wavelength region having corrugations at a second depth, an RF output port located a half wavelength from said corrugations changing from said first depth to said second depth, a gain region having corrugations at said second depth, and a electron beam exit.

A seventh object of the invention is a slow wave structure for an electron beam having an axis, said slow wave structure including, in sequence, an electron beam entrance, a beam shaper having a plurality of slots parallel to said electron beam axis, a plurality of pins having a first depth below said beam shaper and attached to said substrate, a plurality of pins having a second depth below said beam shaper and attached to said substrate, an RF port located a half wavelength from the change from said pin first depth to said pin second depth, a plurality of pins having said second depth and attached to said substrate, and a an electron beam exit.

SUMMARY OF THE INVENTION

A slow wave structure for a backward wave traveling wave tube comprises a substrate having a plurality of pins, known as pintles. The pintles are elongate cantilever structures interacting with an electron beam traveling in a beam tunnel. The pintles have one end mounted to/and perpendicular to the substrate, and an opposing cantilever end. The pintles are small in comparison to the physical wavelength of the electromagnetic wave counter-propagating with the electron beam. The cantilever end of the pintles forms a substantially planar surface in the region of the electron beam, and the substrate supporting the pintles and located below the electron beam includes an exit aperture and at least one step change located a half wavelength from the exit aperture on the electron beam entrance side of the beam tunnel. In backwards wave mode, Radio frequency (RF) energy counter-propagating with the electron beam is reflected by the change in height of the pintles, and is coupled into the output port which is located half a wavelength away from the step change in pintle height. For broadband devices, there may be a plurality of step changes for a plurality of wavelengths, each step change located a half wavelength at some frequency of operation from the exit aperture. The slow wave structure may also include a beam shaper, comprising a ramp perpendicular to the electron beam axis, positioned near the electron beam entrance, and having a plurality of slots parallel to the electron beam axis, such that the slots and pintles form common channels for the electron beam.

BRIEF DESCRIPTION OF THE DRAWINGS

FIG. 4 shows a section view of a backward wave coupler according to the present invention.

FIG. 5*a* shows the detail of the pintles near the waveguide of FIG. 4.

FIGS. 5*b* and 5*c* show a section view of the pintles in the reflection region, the beam shaper region, and the half wave region of FIG. 4.

FIG. 6 shows a section view of a backward wave coupler according to the present invention.

DETAILED DESCRIPTION OF THE INVENTION

Figure 1:
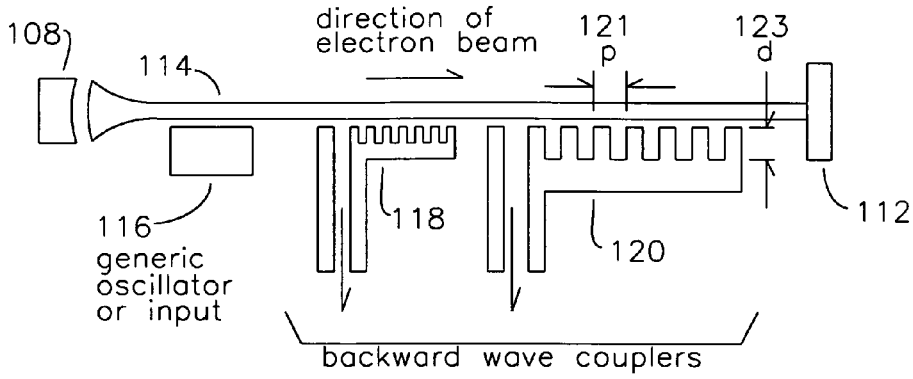
Figure 1 prior art
FIG. 1 is a section view of a prior art traveling wave tube.

FIG. 4 shows the side view of a backward wave coupler 150 for a traveling wave tube, which is defined in a coordinate system y and z axis as shown, and an x axis (shown in FIGS. 5*b* and 5*c*) perpendicular to the y and z axis. An electron beam 152 is emitted from a cathode (not shown) and enters beam tunnel entrance 162, where it travels over beam shaper 153. This beam shaper 153 may have a plurality of slots parallel to the axis of electron beam 152 and over and around a plurality of pintles 154, which comprise corrugations having a pitch p, a width w, a depth d1 as shown in FIG. 5*a*, and may also include slots substantially aligned with the slots of beam shaper 153, and parallel to the axis of electron beam 152. The electron beam 152 may include counter-propagating RF at a wavelength λ, and the pintles 154 are spaced at less than 0.1λ in the z and optionally x directions. The pintle surface plane 166 is planar with a surface of the beam shaper 153 and a z-x plane below the electron beam 152. The pintles may follow the shape of the electron beam 152 to enable maximal coupling between the pintles and the RF carried in the electron beam 152. The pintles 154 are cut to a depth 168 in a half wavelength region having a distance of a multiple of a half wavelength (λ/2) 157 on the beam tunnel entrance 162 side of output aperture 158. The half wavelength distance 157 may also be any integer multiples of wavelength such as (n+1)λ/2 where n is an integer>0. In the reflection region beyond the half wavelength separation distance 157, the pintles change depth 170 while maintaining the same pintle surface plane 166 as the pintles 154 and beam shaper 153. This change in substrate 151 to depth 170 causes RF energy counter-propagating with the electron beam 152 to reflect and co-propagate towards the exit aperture 158, where the counter-propagating RF energy and reflected co-propagating RF energy add in phase to a maximum level in the region of output aperture 158, and couple out. The pintles 154 are shown having a regular period leading up to the output aperture in gain section 161 and following the output aperture 158 in half wave section 157 and reflection section 159. It has been found that removing one or more rows of pintles in the region of the output aperture 158 increases the coupling of reflected RF into output aperture 158. This is shown in FIG. 5*a*, which is a detailed view of FIG. 4 showing the removed rows of pintles 155 in phantom outline with the RF output aperture 158 centered in the resulting gap between pintles 154.

Increased interaction between the RF counter-propagating in the electron beam 152 and the corrugations 154 occurs when slots parallel to the electron beam axis are cut into the beam shaper 153 and corrugations 154, resulting in a slotted beam shaper 153 and pintle structures 154. When slots parallel to the electron beam 152 axis are added to enhance coupling between the counter-propagating RF and corrugations 154, FIG. 5*b* section e—e shows the resulting slotted beam shaper 153. FIG. 5*b* also shows section c—c through FIG. 4 in the x-y plane, showing electron beam 152, pintles 160 at uniform height 166 and a second depth 168, and FIG. 5*c* shows the same view through section d—d of FIG. 4 where the pintles 160 are cut to a first depth 170 in the reflection region 159 of substrate 151 from FIG. 4.

The structure of FIG. 4 can be used as an input port in the forward wave mode by coupling power into input port 158, which co-propagates through gain section 161. It is also possible to use the slow wave structure of FIG. 4 as an output port in forward wave mode by reversing the beam direction such that the electron beam enters at 164 and exits at 162, and the beam shaper is placed at the same height 166, but at 164. In this manner, forward waves co-propagating with the electron beam enter at 164, travel through gain section 161 and co-propagate to exit aperture 158, where they combine with reflected counter-propagating waves from reflection region 159. As described earlier, higher electron beam velocities are used for forward wave devices compared to the backward wave devices description of FIG. 4.

FIG. 6 shows a multi-wavelength reflection slow wave structure 180. Electron beam 184 travels down a beam tunnel having in sequence a beam tunnel entrance 182, a beam shaper 181, a plurality of elongate pintles 185 having one end attached to a substrate 181 and an opposing end which is in proximity to the electron beam 184, the plurality of pintles formed into a reflection region comprising a plurality of pintles cut to decreasing first depths 207, 206, 204, a half wavelength region having the plurality of pintles cut to a second depth, an output aperture 208, and a plurality of pintles 185 at a second depth 202. Each change in pintle depth in the reflection region is spaced a half wavelength from the exit aperture 208 for a given output wavelength. By selecting the particular corresponding wavelengths for these depth changes in the reflection region 196, it is possible to optimize the operation band of the device over a wide range of wavelengths. The plurality of the opposing ends of pintles 185 may be substantially planar with the beam shaper 181 and substantially co-planar with the electron beam 184 axis. The RF counter-propagating with the electron beam 184 travels past the output aperture 208 for the removal of RF energy, and the plurality of pintles 185 changes to a second depth 204 at a first half wavelength distance 190. The pintle depth is again changed to a third depth 206 at a second half wavelength distance 192, and may also continue to subsequent depth 207 at additional half wavelength 194. Each half wavelength distance 190, 192, 194 is associated with a particular half wavelength of RF counter-propagating with electron beam 184 which is reflected as a co-propagating RF wave to sum with the counter-propagating RF wave and couple to output aperture 208. The half wavelength separation distances 190, 192, 194 may also be any integer multiples of wavelength such as $(n+1)\lambda/2$ where n is an integer >0, as was described in FIG. 4. As was described in FIG. 5*a*, a row or more of pintles may be removed and the waveguide 208 centered in the resulting gap to enhance coupling of reflected RF energy to the output aperture 208.

The pintles 154 and 160 of FIG. 4, and 185 of FIG. 6 may be made in a variety of shapes, and arranged in a variety of forms. The pintles may be rectangular or circular, and they may be formed by machining substrates 151, 181, or by chemical etching or electro-discharge machining (EDM) of the substrate, as is known in the art of machining metallic substrates 151 and 181. For any of these machining processes, it is desirable to have the structures formed from a planar surface, as shown in the figures of the present invention. The pintles 154 and 160 of FIG. 4, and 185 of FIG. 6 may comprise corrugations perpendicular to the axis of the electron beam, or they may include slots which are parallel to the axis of the electron beam, and the beam shaper 153 of FIG. 4 and 181 of FIG. 6 may or may not be present, depending on the accuracy of alignment of the electron beam 152 of FIG. 4 and 184 of FIG. 6. In general, the structures of the pintles and beam shaper are formed from a planar substrate.

Figure 7:
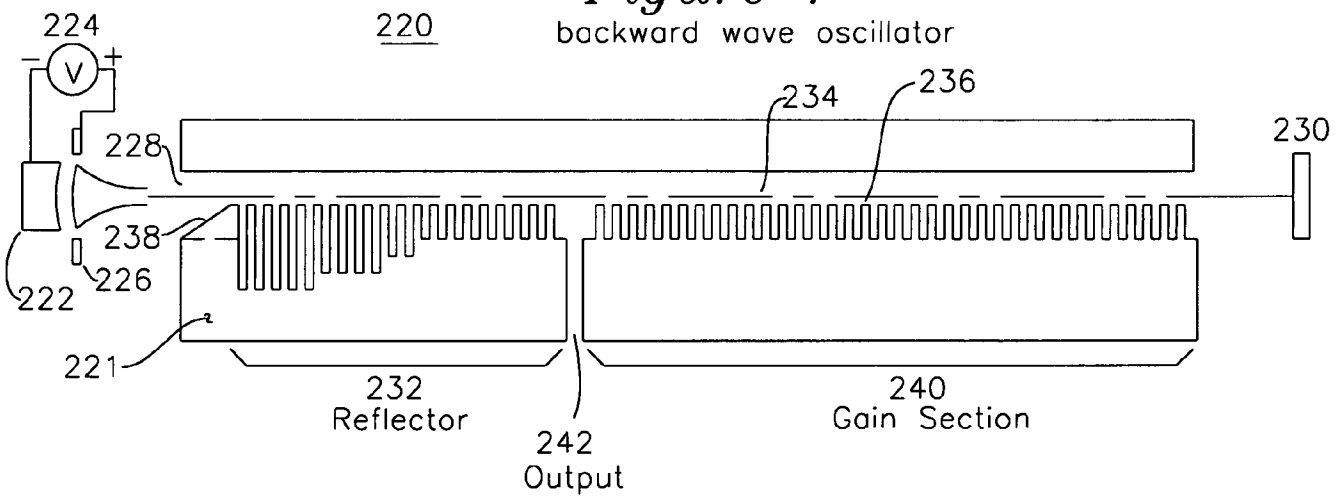
FIG. 7 shows a traveling wave device configured as an oscillator.
Figure 8:
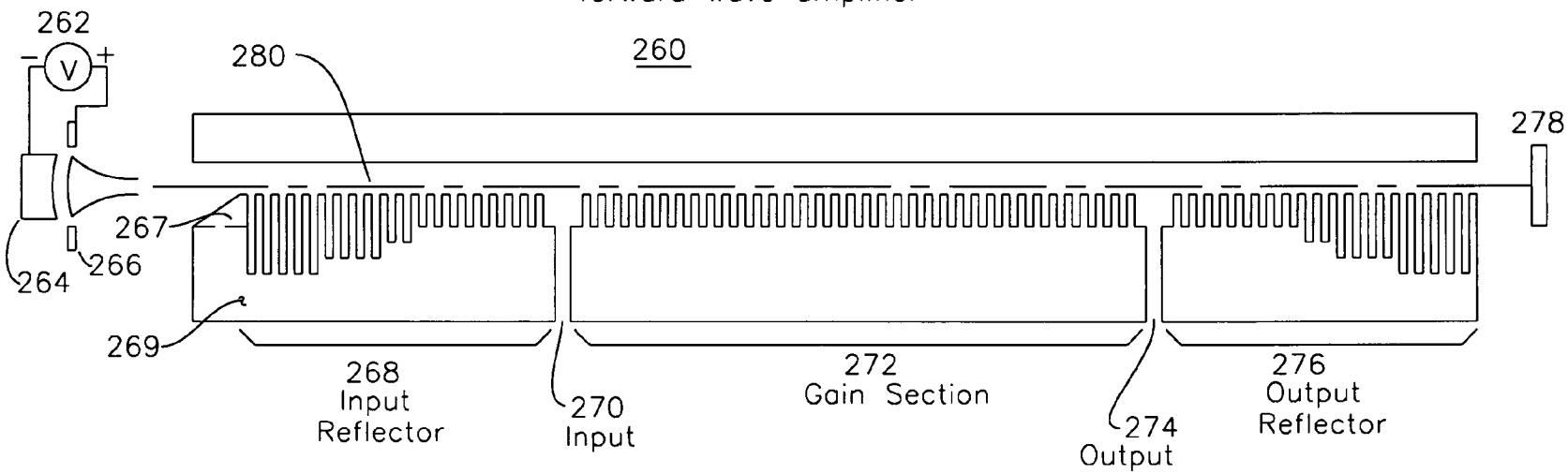
FIG. 8 shows a traveling wave device configured as an amplifier.

The reflector structures shown in FIGS. 4 and 6 may be combined in a variety of ways to form traveling wave tube oscillators and amplifiers using forward wave region or backward wave region operation, for which two examples are shown in FIGS. 7 and 8.

Figure 2:
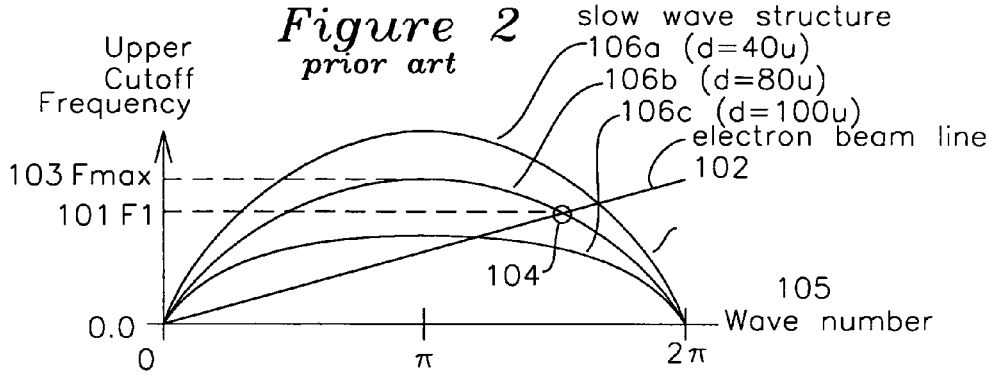
Figure 2 prior art
FIG. 2 is an ω-β graph showing the maximum operating frequency of a microwave tube as a function of electron voltage versus pin depth.
Figure 3:
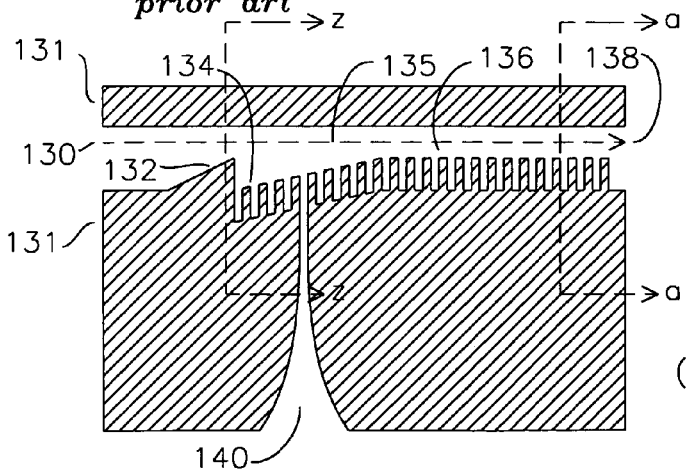
Figure 3 prior art
FIG. 3 shows a section view of a prior art backwards wave coupler.
Figure 3A:
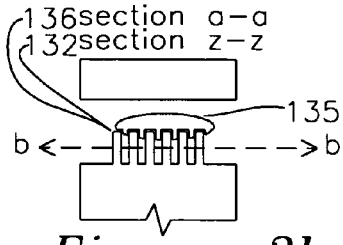
Figure 3a prior art
FIG. 3*a* is a section view through section a—a of FIG. 3.
Figure 3B:
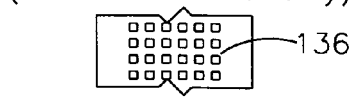
Figure 3b prior art
FIG. 3*b* is a section view through section b—b of FIG. 3.

FIG. 7 shows the present invention used as a tunable wideband oscillator 220 in backward wave mode. A cathode 222 in proximity with an anode 226 has an applied voltage 224 which causes the cathode 222 to emit a beam of electrons 234 in the backward wave region of FIG. 2, which may be focused using an external axial magnetic field (not shown), as known to one skilled in the art. Slow wave structure 221 includes an electron beam entrance 228, a beam shaper 238 followed by a plurality of pintels 236 forming reflector section 232 comprising a plurality of pintles of decreasing depths each successively positioned one half wavelength from output aperture 242 as was described in FIG. 6, an output aperture 242, and a gain section 240. The spent electron beam 234 dissipates in collector 230. RF noise in the gain section 240 is amplified in counter-propagating waves, which are reflected in reflector region 232 to co-propagating waves which combine with the counter-propagating wave and couple into output 242. The internal coupling of forward and reflected waves causes an oscillation at a particular frequency, which is tunable with cathode voltage 224, and the reflector 232 provides for gain over a range of frequencies for which the device may operate.

FIG. 8 shows the present invention used as an forward wave amplifier 260. FIG. 8 shows a pair of RF reflectors of FIG. 4 arranged in a mirror fashion as an input reflector 268 and an output reflector 276. Cathode 264 in conjunction with voltage source 262 and anode 266 supplies a beam of electrons 280 in forward wave mode, which is shaped to the height of the pintels by beam shaper 267, as before. The beam shaper 267 may include slots parallel to the electron beam 280 axis at the same depth as the pintels in the gain section 272. Input RF energy is coupled into port 270, which is coupled into the beam tunnel, whereby some RF energy is directly coupled co-propagating towards collector 278 and some RF energy is reflected by input reflector 268, summing in phase with incoming energy from port 270. The RF co-propagates through gain section 272, and is coupled to output 274 with output reflector 276, as before. The spent beam passes to collector 278. For the amplifier configuration of FIG. 8, the voltage 262 is adjusted to a voltage in the forward wave region of FIG. 2 about which a range of wideband amplification may take place.

While a specific illustration for the backward wave structure has been shown for the purposes of illustration, it is clear that the reflector structure described in FIGS. 4 and 6 may be scaled to any wavelength, and is suitable for frequencies in the thousands of Ghz (Thz) region. It is clear that the reflector comprising a plurality of pintles attached to a common conductive substrate, the pintles having a common height substantially co-planar to an electron beam, a first section which includes an output port, and a reflection section located a multiple of a half wavelength from the output aperture, the reflection section comprising pintles at the same height as the pintles of the first section, but with greater depth distance to the substrate. The structure may be formed from corrugations without any slots substantially co-planar to the electron beam axis, or the corrugations may include slots parallel to the axis of the electron beam, which may improve the coupling efficiency of co-propagating and counter-propagating RF to the output aperture. The structures may be operated in the forward wave region with the RF co-propagating with the electron beam, or in the backward region with the RF counter-propagating with the electron beam according to FIG. 2. Using combinations of the structure described herein, amplifiers and oscillators using forward or backward mode suitable for sub-millimeter RF waves may be formed.

We claim:

1. A slow wave structure for a traveling wave tube, said structure having:

a beam tunnel having an axis, a beam entrance and a beam exit;

a substrate including a plurality of elongate pins, each said pin having an attachment end and a beam tunnel end, said pins perpendicular to said substrate and said beam tunnel end of said pins located in said beam tunnel, said substrate including an exit aperture perpendicular to said beam tunnel, said elongate pin beam tunnel ends forming a substantially planar surface, said elongate pins having a first depth along said beam tunnel from said beam exit to a first distance from said exit aperture, and a second depth from said first distance to said beam entrance.

2. The slow wave structure of claim 1 where said beam tunnel carries an electron beam.

3. The slow wave structure of claim 1 where said beam tunnel carries electromagnetic waves having a wavelength.

4. The slow wave structure of claim 3 where said first distance is half said wavelength.

5. The slow wave structure of claim 3 where said first distance is (n+1)/2 said wavelengths, where n is an integer greater than 0.

6. The slow wave structure of claim 3 where said elongate pins have a pitch less than 0.1 said wavelengths.

7. The slow wave structure of claim 1 where an output port is an aperture perpendicular to said beam tunnel.

8. The slow wave structure of claim 1 where said pins are arranged in rows perpendicular to said beam tunnel axis.

9. The slow wave structure of claim 1 where said pins are arranged in columns parallel to said beam tunnel axis.

10. The slow wave structure of claim 1 where said pins are arranged in rows and columns, said slow wave structure includes a longitudinal gap equal to one or more said columns, and said exit aperture is centered in said gap.

11. The slow wave structure of claim 1, said structure including a beam shaper having slots aligned with gaps between said pins, said beam shaper having a surface substantially planar with said elongate pins beam tunnel ends.

12. A slow wave structure for a traveling wave tube, said structure supporting a plurality of wavelengths and having:

a beam tunnel having an axis, a beam entrance and a beam exit;

a substrate including:

a plurality of elongate pins, each said pin having an attachment end and a beam tunnel end, said elongate pins perpendicular to said substrate and said pin beam tunnel ends substantially co-planar with said beam tunnel axis;

an exit aperture perpendicular to said beam tunnel;

said elongate pins having a plurality of step change depths, each step change depth occurring a unique distance from said exit aperture.

13. The slow wave structure of claim 12 where said beam tunnel carries an electron beam.

14. The slow wave structure of claim 12 where said beam tunnel carries electromagnetic waves having at least one wavelength.

15. The slow wave structure of claim 14 where the distance between said step change depth and said exit aperture is half said wavelength.

16. The slow wave structure of claim 14 where the distance between said step change depth and said exit aperture is (n+1)/2 said wavelengths, where n is an integer greater than 0.

17. The slow wave structure of claim 14 where said elongate pins have a pitch less than 0.1 said wavelength.

18. The slow wave structure of claim 14 where an output port is an aperture perpendicular to said beam tunnel.

19. The slow wave structure of claim 14 where said pins are arranged in rows perpendicular to said beam tunnel axis.

20. The slow wave structure of claim 14 where said pins are arranged in columns parallel to said beam tunnel axis.

21. The slow wave structure of claim 14 where said pins are arranged in rows and columns, said slow wave structure includes a longitudinal gap equal to one or more said columns, and said exit aperture is centered in said gap.

22. An oscillator for radio frequency (RF) waves, said oscillator having:

a beam tunnel formed from a substrate, said beam tunnel having a plurality of elongate pins, said pins having one end connected to said substrate and an opposing beam tunnel end, said elongate pin beam tunnel ends substantially co-planar, said beam tunnel having, in sequence:

a beam tunnel entrance receiving electrons from a thermionic cathode;

a beam tunnel reflection end having a plurality of said elongate pins, said beam tunnel reflection end having one or more reflection regions whereby said elongate pins change depth;

a beam tunnel half wave section with said elongate pins having a first depth;

a beam tunnel exit aperture formed by a gap in said elongate pins;

a beam tunnel gain section with said elongate pins having said first depth;

a beam tunnel exit coupling electrons to a collector;

said oscillator coupling energy to said exit aperture.

23. The oscillator of claim 22 where said beam tunnel entrance includes an electron beam shaper having a surface substantially co-planar with said elongate pin beam tunnel ends.

24. The oscillator of claim 23 where said beam shaper includes slots parallel to said beam tunnel axis.

25. The oscillator of claim 22 where said beam tunnel carries an electron beam.

26. The oscillator of claim 22 where said beam tunnel carries electromagnetic waves having a wavelength.

27. The oscillator of claim 26 where the distance from said reflection region said pin depth change to said exit aperture is half said wavelength.

28. The oscillator of claim 26 where the distance from said reflection region said pin depth change to said exit aperture is (n+1)/2 said wavelengths, where n is an integer greater than 0.

29. The oscillator of claim 26 where said elongate pins have a pitch less than 0.1 said wavelengths.

30. The oscillator of claim 22 where an output port is an aperture perpendicular to said beam tunnel.

31. The oscillator of claim 22 where said pins are arranged in rows perpendicular to said beam tunnel axis.

32. The oscillator of claim 22 where said pins are arranged in columns parallel to said beam tunnel axis.

33. The oscillator of claim 22 where said pins are arranged in rows and columns, said oscillator includes a longitudinal gap equal to one or more said columns, and said exit aperture is centered in said gap.

34. The oscillator of claim 22, said reflection region comprising a plurality of pin depths having a plurality of said pin depth changes, each said pin depth change being (n+1)/2 wavelengths from said exit aperture, where n is an integer greater than 0.

35. An amplifier for radio frequency (RF) waves, said amplifier having:

a beam tunnel formed from a substrate, said beam tunnel having a plurality of elongate pins, said pins having one pin end connected to said substrate and an opposing beam tunnel pin end, said elongate pin beam tunnel pin ends substantially co-planar, said beam tunnel having, in sequence:

a beam tunnel entrance receiving electrons from a thermionic cathode;

a beam tunnel input reflection section, said elongate pins having one or more first depths;

a beam tunnel input half wave section with said elongate pins having a second depth;

a beam tunnel input aperture formed by a gap in said elongate pins having said second depth;

a beam tunnel wave section with said elongate pins having said second depth;

a beam tunnel exit aperture formed by a gap in said elongate pins having said second depth;

a beam tunnel half wave section with said elongate pins having said second depth;

a beam tunnel reflection end having a plurality of said elongate pins, said beam tunnel reflection end having one or more reflection regions whereby said elongate pins change said depth;

a beam tunnel exit coupling said electrons to a collector.

36. The amplifier of claim 35 where said beam tunnel entrance includes an electron beam shaper having a surface substantially co-planar with said elongate pin beam tunnel ends.

37. The amplifier of claim 35 where said beam shaper includes slots parallel to said beam tunnel axis.

38. The amplifier of claim 35 where said beam tunnel carries an electron beam.

39. The amplifier of claim 35 where said beam tunnel carries electromagnetic waves having one or more wavelengths.

40. The amplifier of claim 35 where said beam tunnel carries electromagnetic waves having a plurality of wavelengths, and said input reflections section includes a plurality of said pin said first depths which have an associated $F_{maximum}$ which exceeds at least one of said wavelengths.

41. The amplifier of claim 40 where the separation between said input aperture and the change from said second depth to said one or more first depths is (n+1)/2 said wavelengths for at least one said wavelength, where n is an integer greater than 0.

42. The amplifier of claim 39 where said elongate pins have a pitch less than 0.1 of at least one of said wavelengths.

43. The amplifier of claim 35 where at least one of said input aperture or said output aperture is an aperture perpendicular to said beam tunnel.

44. The amplifier of claim 35 where said pins are arranged in rows perpendicular to said beam tunnel axis.

45. The amplifier of claim 35 where said pins are arranged in columns parallel to said beam tunnel axis.

46. The amplifier of claim 35 where said pins are arranged in rows and columns which include a longitudinal gap equal to one or more said columns, and said exit aperture is centered in said gap.

47. The amplifier of claim 35, including a beam shaper having slots aligned with gaps between said pins, said beam shaper having a surface substantially planar with said elongate pins beam tunnel ends.

* * * * *